United States Patent [19]

Billingsley

[11] Patent Number: 4,658,932

[45] Date of Patent: Apr. 21, 1987

[54] SIMULATED BINAURAL RECORDING SYSTEM

[76] Inventor: Michael S. J. C. Billingsley, 5 Kent St., Montpelier, Vt. 05602

[21] Appl. No.: 830,468

[22] Filed: Feb. 18, 1986

[51] Int. Cl.[4] ..... G10K 11/00

[52] U.S. Cl. ..... 181/175; 181/144; 181/158; 181/242; 381/26

[58] Field of Search ..... 181/175, 144, 146, 157, 181/158, 242, 148; 381/26

[56] References Cited

U.S. PATENT DOCUMENTS 1,814,357 7/1931 Wolff et al. ..... 181/158

4,122,910 10/1978 Wehner ..... 181/148 X 4,421,200 12/1983 Ferralli et al. ..... 181/175 X 4,570,742 2/1986 Takise ..... 181/175

*Primary Examiner*—Benjamin R. Fuller

*Attorney, Agent, or Firm*—Wolf, Greenfield & Sacks

[57] ABSTRACT

A microphone system comprising a pair of microphone capsules, a pair of planar barriers positioned at an angle to each other, with each microphone capsule secured to the center portion of a barrier positioned between the microphone capsules. A baffle is positioned between the microphones with the sidewalls of the baffle extending angularly toward the barriers forming corners with each of the microphone capsules located at the corner.

21 Claims, 4 Drawing Figures

SIMULATED BINAURAL RECORDING SYSTEM

BACKGROUND OF THE INVENTION

Barrier miking, also known as proximity miking, is the technique of mounting a microphone on or very near an acoustically reflective surface. Mounting microphones on barriers, baffles, acoustic boundaries and other surfaces is old in the art and is used to help eliminate acoustic interference or distortion caused as a result of direct and reflected sound waves from the same source arriving at the microphone at different times.

One approach to barrier miking has been the placement of the microphone very close to the floor to reduce the effects of the reflections from the floor boundary. An article by Roger Anderson and Robert Schulein, "A Distant Miking Technique" dB Magazine, Vol. 5, No. 4, pp 29–31 (April 1971), describes a method in which the diaphragm of the microphone is perpendicular to the floor.

Another barrier miking technique described in U.S. Pat. No. 4,361,736 issued to Edward M. Long and Ronald J. Wickersham places the diaphragm of the microphone in a plane substantially parallel to the boundary surface and a small distance from it.

The additional advantage of boundary miking is that direct sound waves couple, via the boundary, with the reflected waves. If the microphone diaphragm is sufficiently close to the boundary surface, the direct and reflected sound waves stay in approximately the same phase relationship up to the highest audible frequencies.

One application of this technique, described in an article by Michael E. Lamm and John C. Lehmann entitled "Realistic Stereo Miking for Classical Recording," *Recording Engineer/Producer* (Aug. 1983) mounts the microphones on the surface of large plexiglass sheets which are hung down from the ceiling of the performance auditorium.

For stereo recording, additional techniques have been employed to increase the accuracy of sound localization (the human ability to accurately pinpoint a source of sound) with special microphone arrangements.

Generally, the most accuracy has been obtained by mimicking the actual human head, using molded plastic, rubber or fiberglass constructions which approximate the human head in size and proportions, particularly in construction of ear pinnae and ear channels.

Designs of this sort, such as are marketed by Japan Victor Corporation and Neumann, A.G., place microphones in the molded "ears" or "ear canals" of the dummy head and closely approximate the human hearing perspective. Recordings made by this method are termed "binaural" or "dummy-head stereo."

A more generalized approach, far more suitable for loudspeaker reproduction than binaural, was described by Alan D. Blumlein in British Pat. No. 394,325 (June 14, 1933). Blumlein described several methods for placing two microphones in immediate proximity to one another (since termed "coincident"), and aimed outwardly from a centerline from the source of sound at angles right and left by approximately 45°. This technique is generally described as the "Blumlein" method.

Blumlein also designed microphone circuitry utilizing two bi-directional microphone elements in the same vertical plane, put at right angles to one another (one facing the source of sound and the other at right angles to it). By utilizing sum-and-difference circuitry described in his patent, fairly convincing localization could be achieved for listeners using loudspeaker reproduction, with the additional advantage that the two coincident microphone signals sum accurately for monaural reproduction. This technique is now popularly termed "mid-side."

Other near-coincident microphone techniques using directional cardioid microphones about ear distance apart, evolved from Blumlein, are still popularly utilized for classical musical recordings and are variously termed "X-Y," "NOS," and "ORTF."

Blumlein also describes a means for separating two microphones by baffling material, which has since been utilized extensively by the British Broadcasting Corporation (BBC). This system, disclosed in more detail in an article by Ron Streicher and Wes Dooley entitled "Basic Stereo Microphone Perspectives—A Review," *J. Audio Eng. Soc.*, Vol. 33, No. 7/8 (July/Aug. 1985), shows two omnidirectional microphones placed on either side of a sound absorptive baffle.

Separated from one another by a distance of six to eight inches, the two omni-directional microphones plus the separating barrier approximate some of the characteristics of binaural recording but this arrangement lends itself more satisfactorily toward loudspeaker reproduction than dummy-head binaural.

Each of the two-microphone systems described above has, with the exception of dummy-head stereo, shortcomings which do not result in a close duplication of the hearing characteristics of the human ear or in some way limit the environment for recording.

The limitations of these approaches include, for example, large size and unwieldiness (Lamm and Lehmann); off-axis coloration and uneven pickup field (X-Y, NOS, ORTF); low and mid-frequency induced phase errors and right-left muddying (BBC); lack of time-of-arrival localization cues (Blumlein, Mid-Side) and lack of essential head-shadow localizations cues due to left/right overlap at mid-to-high frequencies (all except BBC).

Binaural dummy-head methods are extremely rich in head-shadow and time-of-arrival cues and add further complex defraction effects due to the introduction of the ear pinnae shape. These complex wave forms enable approximately 40% of headphone listeners to not only accurately localize on the median plane, but to obtain additional height and front-to-back localization as well.

However, the excellence of binaural recording systems in matched with pragmatic limitations. Headphones must be used by the listener for localization to occur, and with headphones on, approximately 60% experience significant inaccuracies of localization (many experiencing sounds from the rear that originally occurred in front) because individual pinnae structures differ significantly from those molded on the idealized dummy head.

When reproduced from speakers, binaural localization is quite poor and muddied by the complex pinnae-created wave forms. The binaural right/left signals do not sum well to mono, and using the dummy head under field conditions is cumbersome, ungainly and (in public settings) very attention-getting.

It is an object of this invention to overcome the limitations presently existing in binaural, coincident and near-coincident stereo recording methods.

It is a further object of this invention to create right and left microphone signals which sum to mono without distortion or phase-shift caused comb filtration.

More specifically, it is an object of the present invention to provide means that mimic the pickup angles of the human ear.

A further object of the present invention is to provide means by which reception of sound, particularly at higher frequencies (over 2500 Hz), is distinctly different in each microphone channel, while at lower frequencies there is a dual pickup of sound by both microphones which includes time delay phasing errors that simulate those heard by the human ear.

A further object of this invention is to produce right and left microphone signals which, when reproduced on loudspeakers, provide extremely accurate localization, and when reproduced with headphones provide some of the vertical and front-to-back localization normally associated with dummy-head binaural recording.

A further object of the present invention is to provide an improved simulated binaural recording system in which boundary plates are used in association with microphones for purposes of reinforcing frequencies in the audible frequency range arising from the microphone side, and to effectively achieve a flat frequency response for all sounds received from above the boundary while substantially attenuating signals from the other side.

A further object of this invention is to combine the right-and-left low frequencies picked up below 700 Hz in such a way as to overcome the low-frequency attenuation usually associated with boundary plates less than two feet in width and depth.

A further object of the invention is to provide a system which provides a more realistic recording than the prior art by closely duplicating the hearing characteristics of a human head, while eliminating most of the complex waveforms formed by defraction around the human pinna.

The invention also provides a system which is very accommodating of extremes of sound pressure, performance dynamics and source distance.

It is a still further object of the invention to provide a small binaural recording system which is readily portable and usable in a variety of contexts where ease of operation, light weight, and relative unobtrusiveness are desirable.

SUMMARY OF THE INVENTION

The recording system of the invention relates to the transducing of acoustical signals present by a system which accurately duplicates the hearing characteristics of the human head. This system provides more accurate sound localization and frequency information over the "traditional" coincident and near-coincident two microphone techniques, yet introduces none of the more complex information produced by binaural ear pinnae, which "muddy" reproduction of those signals over stereo loudspeakers.

The invention utilizes two omnidirectional microphone capsules, coupled with boundary plates and an acoustic baffle, which mimic some of the defractive and absorptive qualities of the human head. The microphone capsules are spaced to provide both time-of-arrival and head-shadow cues essential for accurate localization. Each microphone responds omnidirectionally for all frequencies within its own response right or left hemisphere, thus simulating the collection pattern of each right or left human ear. Phasing delays are caused by the distance separating the two microphone elements.

The use of omnidirectional microphone capsules eliminates the annoying and inaccurate reproduction effect of off-axis-coloration, which usually mars sound gathering using cardioid microphone capsules. The omnidirectional microphones are selectively spaced to avoid problems inherent in widely spaced apart microphones which confuse low frequency information as a result of time-of-arrival differences while avoiding the problem of total elimination of time-of-arrival cues as in coincident microphones.

The advantages of the present invention are achieved in a preferred embodiment which includes a pair of spaced apart omnidirectional microphone capeules secured to adjacent planar barriers, which in turn are arranged at an angle to one another. A baffle between the microphone capsules has sidewalls that extend toward the microphones to form corners with the boundary at the microphones.

BRIEF DESCRIPTION OF THE DRAWINGS

These and other objects and advantages of the present invention will be more clearly understood from the following description with reference to the accompanying drawings in which.

DETAILED DESCRIPTION OF THE DRAWINGS

Figure 3:
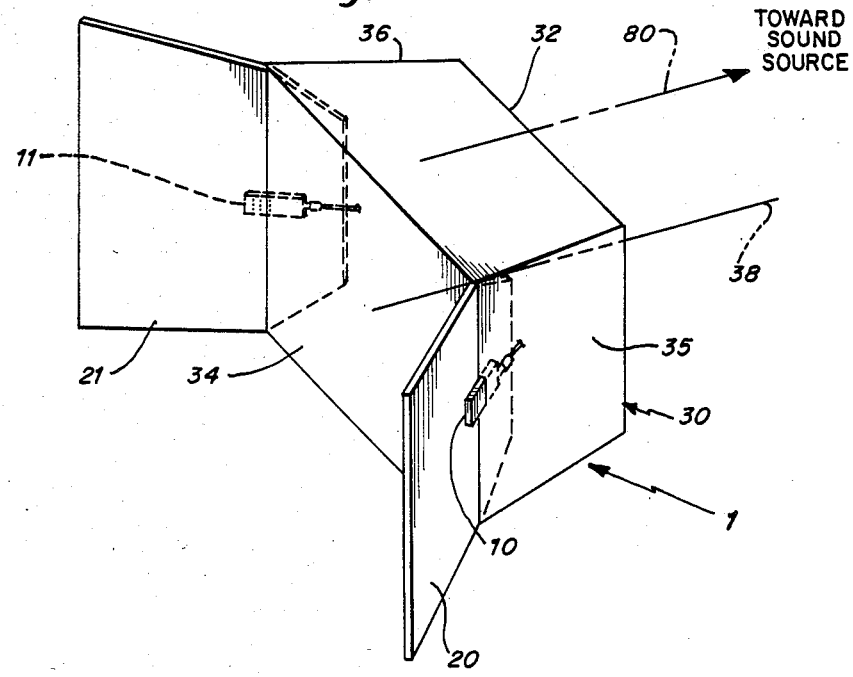
FIG. 3 is a perspective view of a preferred embodiment of the invention.

The recording system 1 of the invention as shown in FIG. 3 comprises a pair of omnidirectional microphone capsules 10, 11. The microphone capsules 10, 11 may be pressure zone omnidirectional units as commercially produced by Crown International Inc., Realistic, and Milan Audio, or Countryman adhesive-mounted omnis.

The microphone capsules 10, 11 are each secured one each to opposing boundary plates 20, 21. The boundary plates 20, 21 are flat acoustically reflective panels, preferably composed of smooth, flat metal sheet or plate although other highly reflective materials may be used so as to accurately reflect sound waves. The height of the boundary plates 20, 21 may range from three inches to four feet, however, a height of five inches is preferred to optimize low frequency response versus ease of handling.

The boundary plates may have any thickness that is convenient provided it is thick enough to be self supporting and function as an acoustical barrier and reflector. The length may also vary over a wide range depending upon the specific commercial embodiments contemplated. Preferably the range should be at least 3.5 inches but may be as much as four feet.

Figure 1:
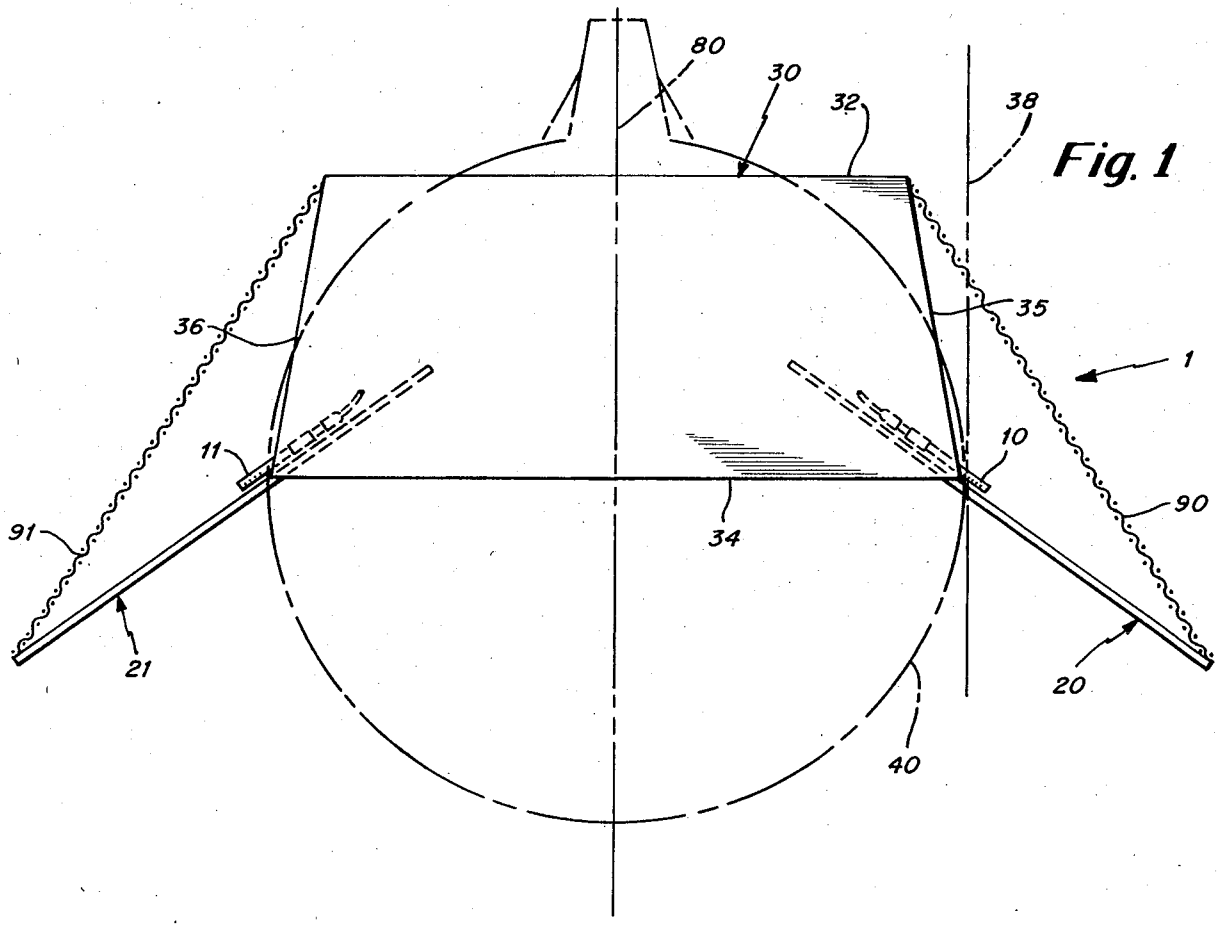
FIG. 1 is a top view of a recording system embodying a preferred form of the present invention.
Figure 2:
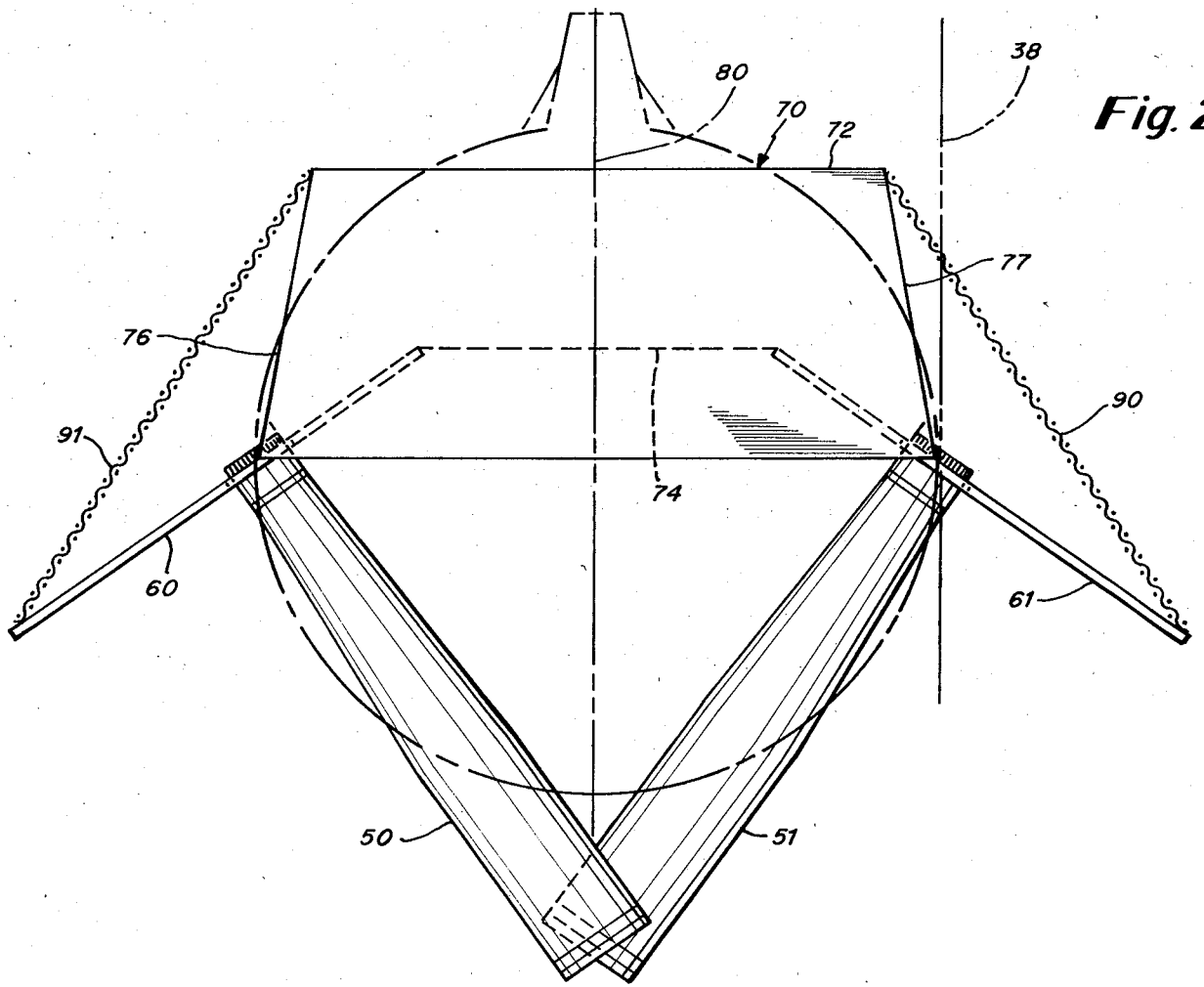
FIG. 2 is a top view of another embodiment of the invention.
Figure 4:
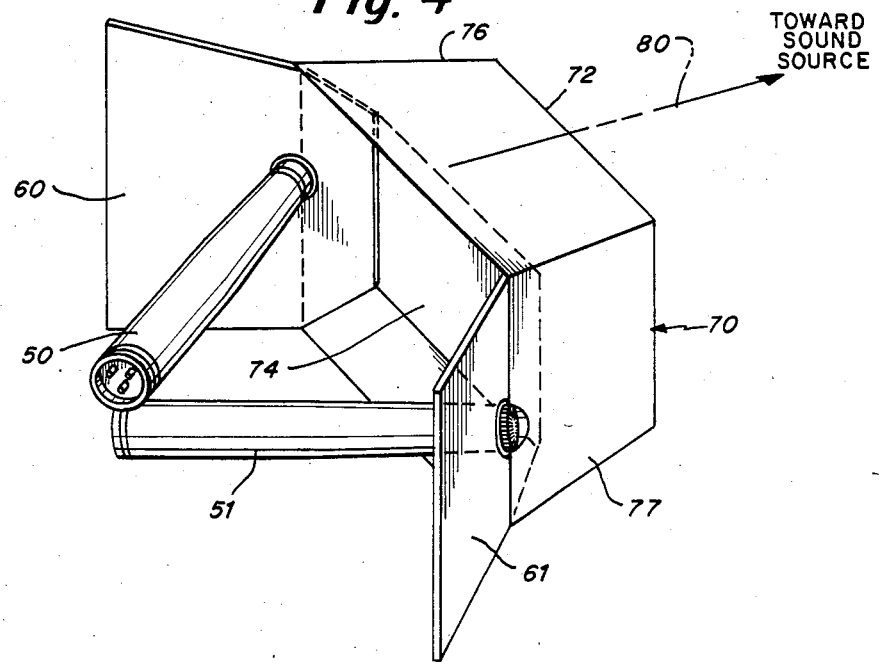
FIG. 4 is a perspective view of another embodiment of the invention.

As shown in FIGS. 1 and 3, the microphones are secured to the plates 20, 21 by any suitable and conventional securing means which rigidly holds the microphone capsules in a fixed position. Alternately the microphone capsules may be secured in holes found in the plates with the microphone body projecting from the rear forwardly as illustrated in FIGS. 2 and 4. The microphone wiring may be secured on the rear of the plates in a conventional fashion and may be conventionally connected to a power source and recording instruments (not shown). If a conventional omnidirectional microphone is used, such as Bruel & Kjaer models 4004/4007, the hole in which the microphone capsules is secured should be sealed with an O ring or the like to seal off any sounds from the rear of the plate. In addition, the diaphragm of the microphone projecting through the hole should be flush with the forward surface of the plates. If a pressure zone microphone is used it should face rearwardly.

The effective distance between the microphone capsules 10, 11 is preferably approximately 6.75 inches so as to approximate the width of a human head. A range of about 5.5 inches to 8.0 inches is within an acceptable range.

The plates 20, 21 are attached to an acoustic baffle 30. The baffle 30 functions as a sound absorbing barrier and preferably has a smooth surface although the surface may be roughened. The barrier 30 is preferably composed of acoustical foam although other well known acoustically absorbent or acoustically reflective materials including metal may be used. The baffle 30, however should preferably be made of sound absorbing material which attenuates frequencies above 1200 Hz by a minimum of 3 db per inch.

In the preferred embodiment, the baffle 30 has a trapezoidal projection as illustrated in FIGS. 1 & 2. The baffle 30 has a height of preferably 4.5 to 5 inches although a range of between two inches and four feet is acceptable. The minimum height should however be at least sufficient to span the entire height of the boundary plates at their intersecting edges. As illustrated in FIG. 1 the forward wall 32 of the baffle has a width of 5.75 inches while rear wall 34 has a length of preferably 6.75 inches but may have a range of between approximately 5.5 inches to 8.0 inches. The distance of forward wall 32 to rear wall 34 is preferably 3 inches although the distance may range between approximately 2 inches and 48 inches. The sidewalls 35, 36 of the baffle 30 are inclined angularly from a line 38 normal to the rear wall 34 inwardly at an angle preferably 10° plus or minus 10° as illustrated in FIG. 1. The boundaries 20, 21 intersect the baffle 30 at the edges defined between the rear wall 34 and the side walls respectively 35, 36. The boundaries 20, 21 are arranged at an angle to each other preferably in the order of 110° plus or minus 30°.

As illustrated, microphone capsules 10, 11 are located respectively at the intersection of boundary plate 20 and sidewall 35 on one side and boundary plate 21 and sidewall 36 on the other side of this simulated binuaral recording system. This configuration in substance mathematically simulates a human head which is diagrammatically illustrated in dotted outline in FIGS. 1 & 2 at 40. In this arrangement it will be noted the microhone capsules 10, 11 are situated at distances apart that roughly equal the distance apart of human ears, with the interposed foam acoustic baffle 30 simulating the human head. The boundary plates 20, 21 in part function to attenuate signals from the rear in frequencies above 2000 Hz to at least 18 dB.

Certain apparent advantages are achieved by the arrangement described above. Thus for example the use of boundary plates adjacent (within $\frac{1}{8}$ wavelength) to the omnidirectional microphone diaphragms couples the acoustic reflections from the boundary plates to the direct air pickup of the diaphragm, giving a greater than 3 dB boost (without phase-error coloration) for all frequencies above approximately 550 Hz (depending upon the scale of the model). In addition, there are benefits in the use of boundary plates by virtue of the attenuation of all frequencies (above approximately 500 Hz) of acoustic information coming from behind the boundary plate by an average factor of approximately 18 dB, increasing with frequency.

When the two ("right" and "left") boundaries 20, 21 are arranged so they are rearwardly angled at 110° right and left of center-front, the attenuation characteristics of the combined boundaries creates a "rear" area corresponding to the back of the human head. Only low frequency information can be detected arriving from the rear, allowing the listener to differentiate rear-left, for instance, from front-left.

The microphone pair has a "front" and a "rear". The microphones perspective, once coupled with the plates, is in the form of two hemispheres which overlap in the front but have a deliberately created blind spot to the rear. This enables the creation of distinctions for the listeners of "front" and "behind" sound sources. As the "behind" sources move forward around a side, their timbre and source versus reverberation content changes, thereby helping to identify their positions.

The zenith for each hemisphere represents the equivalent of 35° right and 35° left. The hemispheres would overlap in the front by 110°, which is highly undesirable since that field of "shared" pickup encompasses much of the acoustic information which is customarily recorded. In order to achieve some exclusivity of right and left channel information, particularly at higher frequencies where phase error between right and left spaced elements causes comb filtration, additional baffling and attenuation is desired. This is provided as described above by the baffle 30. Since the microphone capsules are positioned on or within the boundary plates so that their effective distance from one another is approximately 6.75 inches (the approximation of the human headwidth) baffling of low frequencies is not essential. Wavelengths are sufficiently long below 500 Hz to prevent comb filtering from occurring when summing right and left spaced (6.75 inches) omnis to mono, and below approximately 1000 Hz the human brain uses time delay (phase error) differences rather than intensity cues to achieve localization. Ordinarily, low frequency sounds are less easily perceived by boundary microphones unless the boundary itself is of considerable size. That is, there exists a loss of acoustic boundary coupling between the microphone and the boundary plate below approximately 550 Hz. However, at this scale, with the boundary plates not exceeding approximately 5" in either width or height, the brain will still sum the low frequency inputs from right and left and perceive them in terms of summed intensity, thereby reinforcing the inputs. This gives a perceived gain of 3 dB at the low frequencies, which compensates for the roll-off otherwise experienced using plates of these small dimensions and, therefore, there is no perceived low frequency drop-off as the sound waves arrive at the two microphones approaching 0° phase. As a consequence of the way the brain processes low frequency information, only the mid and high frequencies need to be attenuated by the "center" baffle. The attenuation provided by baffle 30 prevents an overlap of the right and left pickup hemispheres. Additionally, it acts as a refracting mask to simulate the defraction effects of the human side-of-head, caused by the protrusion of the cheek, cheekbone, temple and upper skull area in front of human ears, thereby shaping the sound field that is presented to the right and left microphones.

Further, although its surface should be smooth, even when slightly roughened the baffle still acts as an additional acoustic coupler when designed to meet the boundary plates within $\frac{1}{8}$ wavelength distance (given f=20,000 Hz) of the microphone diaphragm. Depending on the smoothness of the baffle surface and the frequency, coupling can add up to 3 dB to sound arriving from the front, giving a slight "center-weighing" to the pickup pattern. A smooth surface is recommended to minimize coloration.

The baffle's primary role is to attenuate frequencies above 1000 Hz (with increased attenuation with rising frequency) by at least 9 dB so the hemispherical right and left pickup patterns are truncated, making exclusive data available to opposite microphone elements. This exclusive sound information, particularly crucial above 2500 Hz, allows the brain to process head-shadow cues which permit accurate localization at the higher frequencies without introducing comb filtration distortion to disrupt full frequency mono summation of the two channels.

FIGS. 2 & 4 illustrate a modification of the present invention. In this modification, left microphone 50 and right microphone 51 are secured respectively to boundary plates 60, 61 preferably at the center of the boundary plate. The microphones 50, 51 are suitably supported and secured from the rear of the boundary plates through appropriate openings so as to project toward and preferably flush with the forward surfaces of the plates 60, 61. The plates 60, 61 are arranged to form a rearwardly extending angle of preferably 110° plus or minus 30°. The plates themselves may vary in size and shape in a manner as previously described but in the preferred embodiment of this modification are each squares of approximately 5 inches per side.

A acoustic baffle 70 is secured to and stands on the boundary plates 60, 61. The baffle 70 is made of an acoustic material of the type previously described and has a regular shape as illustrated. The front wall 72 of the baffle is perpendicular to the central axis 80 of the present invention when measured on both the vertical and horizontal planes, and is essentially parallel to the rear wall 74 of the baffle, although the rear wall 74 may be indented as illustrated in FIG. 4 to permit insertion of the boundary plates 60, 61. The microphone capsules 10, 11 are located at the intersection of the edge walls 76, 77 of the baffle with the plates 60, 61 respectively. The corners formed respectively by the baffle wall 77 and boundary 61, and baffle wall 76 and boundary 60, are preferably at an angle of substantially 135° with the microphone capsules located in the edge formed thereby.

As shown in FIGS. 1 and 2, a screen 91, made of acoustically transparent material which may be either rigid or flexible, may be attached or stretched from the vertical rear edge of the left boundary 60, 21 to the leading left vertical edge of the baffle 70, 30 and a similar screen 90 may be stretched or attached from the vertical rear edge of the boundary 61, 20 to the right vertical leading edge of the baffle 70, 30 to reduce wind noise at the microphone diaphragms.

The combination of boundaries and baffles of the invention makes it possible for the human listener to accurately localize uncolored sound at the time of reproduction in stereo, while still permitting r/1 signals to be summed accurately to mono.

In addition, the overall design permits construction of a lightweight, maneuverable system of simulated binaural microphone pickup, lending itself to applications ranging from symphonic music recording to location news coverage and ambience effects.

What is claimed is:

1. A microphone system, comprising:

a pair of microphones, each of said microphones comprising a capsule;

means forming a pair of planar barriers positioned at an angle to each other;

means securing each of said microphone capsules adjacent separate ones of said barriers at spaced apart distances; and an acoustic baffle positioned between said microphones, means connecting said baffle to each of said barriers, said baffle having a plurality of sidewalls, and wherein at least one of said sidewalls extends angularly toward one of said barriers and forms a corner therewith.

2. A microphone system according to claim 1 wherein said microphone capsules are each positioned proximate to each of said corners.

3. A microphone system according to claim 1 wherein the pair of planar barriers are positioned at an angle of between 60° and 140° to each other.

4. A microphone system according to claim 1 wherein the baffle may be composed of porous material.

5. A microphone system according to claim 4 wherein the porous material is acoustically absorbing foam.

6. A microphone system according to claim 1 wherein the baffle may be composed of non-porous material.

7. A microphone system according to claim 6 wherein the non-porous material is acoustically reflective metal.

8. A microphone system according to claim 1 wherein each of the barriers is positioned at an angle of between 80° and 140° to each of the side walls of the baffle.

9. A microphone system according to claim 8 wherein the angle formed between the baffle and each of the barriers is equal.

10. A microphone system according to claim 1 wherein the distance between said microphone capsules is between 5.5 inches and 8.0 inches.

11. A microphone system according to claim 1 wherein said microphone capsules are omnidirectional.

12. A microphone system according to claim 1 wherein said barriers are composed of sound reflecting material.

13. A microphone system according to claim 1 wherein the baffle is shaped so as to prevent high frequency phase cancellation from occurring in summed signals from said microphone capsules.

14. A microphone system according to claim 1 wherein said baffle has a depth of between 2 inches and 48 inches.

15. A microphone system according to claim 1 wherein said barriers have a height of between 2 inches and 4 feet.

16. A system as set forth in claim 1 wherein said microphone capsules are omnidirectional and are spaced apart a distance of approximately 5.5 to 8 inches, said planar barriers are positioned at an angle of between about 60° and 140°, and with said baffle simulating the frontal hemisphere of a human head between said microphone capsules.

17. A system as set forth in claim 16 wherein said barriers are formed of sound absorbing material, and said baffle is formed of sound absorbing material which attenuates frequencies above 1200 Hz by a minimum of 3 db per inch.

18. A microphone system comprising:

a pair of microphones, each of said microphones comprising a capsule;

means forming a pair of planar barriers positioned at an angle to each other, each of said barriers having an aperture through which one of said microphone capsules projects;

means securing each of said microphones to separate ones of said barriers; and an acoustic baffle positioned between said microphone capsules, means connecting said baffle to each of said barriers, said baffle having a plurality of sidewalls, and wherein at least one of said sidewalls extends angularly toward one of said barriers and forms a corner therewith.

19. A microphone system according to claim 18 wherein each of said microphone capsules has a diaphragm means positioned proximate to each of said corners.

20. A microphone system according to claims 1 or 18, wherein each of said barriers has a rear edge and said baffle has a vertical edge forward of said rear edges, and further comprising a screen extending from a rear edge of one of said barriers to a vertical edge of the baffle.

21. A microphone system according to claims 1 or 18, wherein said baffle is composed of sound absorbing material which attenuates frequencies above 1200 Hz by a minimum of 3 dB per inch.

* * * * *